US005593817A

United States Patent [19]

Henderickx et al.

[11] Patent Number: 5,593,817

[45] Date of Patent: Jan. 14, 1997

[54] DEVELOPING SOLUTION AND METHOD FOR DEVELOPING AN EXPOSED SILVER HALIDE PHOTOGRAPHIC MATERIAL

[75] Inventors: Freddy Henderickx, Olen; Ann Verbeeck, Begijnendijk; Pascal Meeus, Turnhout; Hieronymus Andriessen, Beerse, all of Belgium

[73] Assignee: AGFA-Gevaert, N.V., Mortsel, Belgium

[21] Appl. No.: 594,144

[22] Filed: Jan. 31, 1996

[30] Foreign Application Priority Data

Feb. 21, 1995 [EP] European Pat. Off. ..... 95200417

[51] Int. Cl.[6] ..... G03C 5/305

[52] U.S. Cl. ..... 430/488; 430/436; 430/440; 430/441; 430/442; 430/446; 430/480; 430/481; 430/483; 430/486

[58] Field of Search ..... 430/435, 436, 430/438, 440, 441, 442, 446, 478, 480, 481, 483, 486, 488

[56] References Cited

U.S. PATENT DOCUMENTS

| | | | |
|---|---|---|---|
| 3,984,243 | 10/1976 | Shimamura et al. | 430/490 |
| 4,254,215 | 3/1981 | Kramp et al. | 430/488 |
| 4,985,348 | 1/1991 | Hirano | 430/488 |
| 5,384,232 | 1/1995 | Bishop et al. | 430/446 |
| 5,474,879 | 12/1995 | Fitterman et al. | 430/486 |

*Primary Examiner*—Hoa Van Le
*Attorney, Agent, or Firm*—Breiner & Breiner

[57] ABSTRACT

A photographic developing solution and a method of developing silver halide materials in the said developing solution is disclosed, the said developing solution comprising hydroquinone in an amount from 0 to 30 g per litre, an auxiliary developer, and silver halide complexing agents in an amount from 0 to 50 g per litre, characterized in that said developer further comprises in amounts from 0.1 to 5 g per litre a compound corresponding to the formula (I), accompanied by charge compensating anions, $$Z'N^+—R—N^+Z'' \quad (I)$$

wherein at least divalent group R contains at least one oxyethylene group and wherein Z' and Z'', being the same or different, are composed of enough atoms to form a heterocyclic aromatic 5- or 6-ring;
and at least 1 g of a compound corresponding to the formula (II), a precursor thereof, a derivative thereof and/or a metal salt thereof

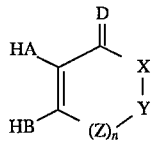

(II)

wherein each of A, B and D independently represents an oxygen atom or $NR^1$;

X represents an oxygen atom, a sulphur atom, $NR^2$; $CR^3R^4$;C=O; C=$NR^5$ or C=S;

Y represents an oxygen atom, a sulphur atom, $NR'^2$; $CR'^3R'^4$; C=O, C=$NR'^5$ or C=S;

Z represents an oxygen atom, a sulphur atom, $NR''^2$; $CR''^3R''^4$; C=O; C=$NR''^5$ or C=S;

n equals 0, 1 or 2;

each of $R^1$ to $R^5$, $R'^1$ to $R'^5$ and $R''^1$ to $R''^5$ independently represents hydrogen, alkyl, aralkyl, hydroxyalkyl, carboxyalkyl; alkenyl, alkynyl, cycloalkyl, cycloalkenyl, aryl or heterocyclyl;
and wherein $R^3$ and $R^4$, $R'^3$ and $R'^4$, $R''^3$ and $R''^4$, may further form together a ring; and
wherein in the case that X=$CR^3R^4$ and Y=$CR'^3R'^4$, $R^3$ and $R'^3$ and/or $R^4$ and $R'^4$ may form a ring and wherein in the case that Y=$CR'^3R'^4$ and Z=$CR''^3R''^4$ with n=1 or 2, $R'^3$ and $R''^3$ and/or $R'^4$ and $R''^4$ may form a ring.

21 Claims, No Drawings

DEVELOPING SOLUTION AND METHOD FOR DEVELOPING AN EXPOSED SILVER HALIDE PHOTOGRAPHIC MATERIAL

DESCRIPTION

1. Field of the Invention

The present invention relates to a developing solution and a method for developing an exposed photographic silver halide material.

2. Background of the Invention

It is known that by processing a silver halide photographic material finely divided metallic silver, so-called silver deposit, is formed in the developer (ref. e.g. Photographic Silver Halide Diffusion Processes by A. Rott and E. Weyde—The Focal Press, (1972), p. 67). The formation of silver deposit is particularly disturbing in automatic processing apparatus wherein it results in deposits of black silver on conveyor and transport rollers and smudging of photographic material conducted therewith.

The formation of silver deposit can be attributed to the presence in conventional developers of silver halide complexing agents like, e.g., sulphite and thiocyanate ions. In this medium the complex ions formed are effectively reduced to metallic silver nuclei. Growth of said nearly invisible fine nuclei leads to the formation of said silver deposit. As a consequence regularly cleaning of the automatic processing machines is required. When a film is introduced into the processor as first film of a whole series of films, its first contact with the first stained roller releases the deposit from the said roller or disturbs the deposited layer. As a consequence after one rotation of the said roller the unevenly distributed dirt or stain comes into contact again with the transported film surface so that it may be deposited onto said surface. This phenomenon is recurrently repeated, not only at the first roller, but also at the further rollers that are mounted onto the racks. The crystalline silver deposit may further cause damaging of the surface of the coated hydrophilic layers on the film and/or cause locally situated pressure phenomena, resulting in "artefacts", thereby seriously impeding the diagnostic value of the obtained image. Especially when the silver halide photographic material shows processed images with a diagnostic value, like, e.g., in medical imaging or in non-destructive testing, said diagnostic value may be impaired. Besides the occurrence of this defect in processed materials for radiographic recording and duplicating, it can also be detected at films and papers for general amateur and professional photography, at materials for pre-press graphic arts applications, films for cinematographic recording and printing, materials which after processing can serve as planographic printing plates, microfilm applications, etc.

In order to prevent the formation of silver deposit it has been proposed to add particular compounds to the developer, forming sparingly soluble and non-reducible silver salts, as, e.g., 5,5'-bis-1,2,4-triazoline-3-thiones or derivatives of 1,3,4-thiadiazole-2-thiols as described, e.g. in BE-P 606,550 and GB-P 1,120,963, 2-mercapto-1,3,4-thiadiazoles described in U.S. Pat. No. 3,212,892. A great variety of other mercapto compounds has been described in FR-P 1,470,235 and 1-phenyl-5-mercapto-tetrazole compounds having a —NHX substituent on the phenyl nucleus have been disclosed in GB-P 1,471,554. In the latter document it has been described that the emulsion layer may contain auxiliary coating agents such as saponin, sodium lauryl sulphate, dodecylphenol polyethylene oxide ether and hexadecyltrimethyl ammonium bromide.

The same result can be obtained by the presence in the developer of 1-phenyl-5-mercaptotetrazole, but if it is used in an amount higher than necessary for reducing fog in the silver halide photographic material, the sensitivity of the said material is markedly reduced. Such effect is probably due to the penetrating of the 1-phenyl-5-mercaptotetrazole from the developer liquid into the exposed photographic silver halide emulsion layer and its interaction with latent image nuclei. More recently triazolium thiolates for use in the developer have been described in, e.g., EP-A 0 533 182.

In EP-Specification 0 223 883 a method has been described which comprises the treating of a silver halide photographic material with an aqueous alkaline liquid in the presence of (i) a developing agent, (ii) a heterocyclic mercapto compound including an aliphatic group of at least 3 carbon atoms and (iii) a surface active agent, characterized in that said surface active agent is an anionic alkylphenoxy polyalkyleneoxy phosphate ester surfactant.

In EP-A 0 620 484 reduction of the so-called "pi-line" defect, especially for processed materials for non-destructive testing purposes, has been described. Such materials should comprise at least one vinyl sulphone compound as a hardening agent and at least one polyoxyalkylene compound as a surfactant in at least one of its hydrophilic layers. Combined with a processing method comprising a developing step wherein the developer comprises as a surfactant at least one anionic alkylphenoxy and/or alkoxy polyalkyleneoxy phosphate ester, sulphate ester, alkyl carboxylic, sulphonic or phosphonic acid and/or a salt thereof a remarkable improvement has been obtained. A similar result has been obtained as disclosed in EP-A's 0 621 506 and 0 620 483.

Although said methods are very effective it is not more than a "treating method" wherein the amount of silver nuclei is not decreased but wherein said nuclei are more "dispersed" and are merely inhibited to grow further to form larger crystalline silver deposits. No "curing" effect in the sense of reducing the generation of nuclei can be obtained with these methods. Moreover the stability of the developer, especially its sensitivity to oxidation by contact with air oxygen, is not reduced either.

OBJECTS OF THE INVENTION

It is an object of the present invention to provide a stable developer and a method for developing a photographic silver halide material wherein the formation of silver deposit is reduced effectively without adversely affecting photographic speed.

It is a further object of the present invention to provide a suitable sensitometry for the material processed in the developer used according to the method of this invention.

Moreover it is an object to provide a developing method, wherein the developer is stable against oxidation by air oxygen as a low regeneration volume per square unit of the said material should be highly appreciated.

Other objects and advantages of the present invention will become clear from the further description.

SUMMARY OF THE INVENTION

It has surprisingly been found now that the objects of the invention can be attained by providing a developer, comprising hydroquinone in an amount of from 0 to 30 g per litre, an auxiliary developer, and as silver halide complexing agents alkali metal sulphite salts, preferably sodium salts, in an amount of less than 50 g per litre and more preferably less than 40 g per litre, characterized in that said developer further comprises in amounts from 0.1 to 5 g per litre a compound corresponding to the formula (I), accompanied by charge compensating anions, $$Z'N^+—R—N^+Z'' \quad (I)$$

wherein at least divalent group R contains at least one oxyethylene group and wherein Z' and Z", being the same or different, are composed of enough atoms to form a (substituted or unsubstituted) heterocyclic aromatic 5- or 6-ring; and at least 1 g of a compound corresponding to the formula (II), a precursor thereof, a derivative thereof and/or a metal salt thereof

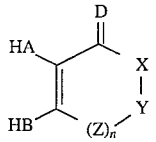

(II)

wherein each of A, B and D independently represents an oxygen atom or $NR^1$;

X represents an oxygen atom, a sulphur atom, $NR^2$; $CR^3R^4$; C=O; $C=NR^5$ or C=S;

Y represents an oxygen atom, a sulphur atom, $NR'^2$; $CR'^3R'^4$; C=O, $C=NR'^5$ or C=S;

Z represents an oxygen atom, a sulphur atom, $NR''^2$; $CR''^3R''^4$; C=O; $C=NR''^5$ C=S;

n equals 0, 1 or 2;

each of $R^1$ to $R^5$, $R'^1$ to $R'^5$ and $R''^1$ to $R''^5$ independently represents hydrogen, (subsituted or unsubstituted) alkyl, aralkyl, hydroxyalkyl, carboxyalkyl; (substituted or unsubstituted) alkenyl, (substituted or unsubstituted) alkynyl, (substituted or unsubstituted) cycloalkyl, (substituted or unsubstituted) cycloalkenyl, (substituted or unsubstituted) aryl or (substituted or unsubstituted) heterocyclyl:

and wherein $R^3$ and $R^4$, $R'^3$ and $R'^4$, $R''^3$ and $R''^4$, may further form together a ring; and wherein in the case that $X=CR^3R^4$ and $Y=CR'^3R'^4$, $R^3$ and $R'^3$ and/or $R^4$ and $R'^4$ may form a ring and wherein in the case that $Y=CR'^3R'^4$ and $Z=CR''^3R''^4$ with n=1 or 2, $R'^3$ and $R''^3$ and/or $R'^4$ and $R''^4$ may form a ring.

DETAILED DESCRIPTION OF THE INVENTION

It has unexpectedly been found that a solution of the problem of silver deposit and stability of a developer containing developing agents and lower amounts of silver complexing compounds like alkali metal sulphite salts, is offered by the addition to the said developer of at least 1 g of a compound corresponding to the formula (I) and at least 1 g of a compound corresponding to the formula (II), a precursor thereof, a derivative thereof and/or a metal salt thereof.

In a preferred embodiment for the compounds according to formula (I), found as working equivalent as alkali metal thiocyanates in the proposed amounts, the said heterocyclic aromatic rings are the same or different and represent a pyridine, a pyrimidine, an imidazol, a benzimidazol, a thiazol, a benzothiazol or a derivative thereof. In a still more preferred embodiment in the structure according to the formula (I) at least divalent group R represents at least 3 oxyethylene-units. Optionally at least one of the ring substituents represents at least one oxyethylene-unit.

More specifically, a preferred compound is

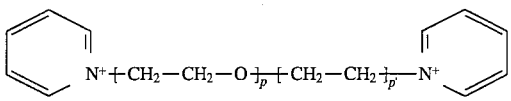

wherein p=3 to 10 and p'=1 to 4; and still more preferred the same compound wherein p equals a value of 4, whereas p' equals a value of 1. As pyridinium cations are present, anions are required to neutralize the total electrical charge of these N-heterocyclic aromatic onium compounds. Preferred anions are sulphonate anions, like methylsulphonate and the like, toluyl sulphonate, carbamate, benzoate, glutamate, perchlorate, sulphate etc. In a more preferred embodiment the said anions are p-toluyl sulphonate.

The presence of oxyethylene units in the general formula (I) makes the said formula substantially different from the formulae set forth in U.S. Pat. No. 5,384,232 and EP-A 0 585 792.

In a preferred embodiment for compounds according to the formula (II) A, B and X each represent an oxygen atom; n=0; $Y=CH—(CHOH)_m—CH_2—R^6$ wherein m=1,2,3 or 4 and wherein $R^6$ represents OH for m=1; H or OH for m=2,3 or 4. This formula corresponds with (iso)ascorbic acid, which is, together with 1-ascorbic acid, a preferred form of formula (I). In another preferred embodiment A and B each represent an oxygen atom; n=O and each of X and Y represent $C(CH_3)_2$. This formula corresponds with tetramethylreductic acid. The compound(s) according to formula (I) preferably is(are) present in the developer solution in an amount comprised between 1 g and 50 g per litre. Examples of reducing precursor compounds have, e.g., been described in WO's 94/3834 and 94/16362, which are both incorporated herein by reference.

It is clear that within the context of this invention ascorbic acid is not merely used in the developer as an antioxidant as, e.g., described in WO 93/12463, in JP-A's 4428673 and 55149936, in GB 1,266,533 and in U.S. Pat. Nos. 3,865,591; 4,756,997 and 4,839,259 and in the literature as, e.g., J. Am. Chem. Soc., 60 (1938), p. 99 and p. 2084; 61 (1939), p. 442; 64 (1942), p. 1561, 65 (1943), p. 1489; 66 (1944), p. 700 and 104 (1982), p. 6273.

The developer liquid may contain any combination of hydroquinone as a developing agent and auxiliary developer known for use in the development of exposed photographic silver halide, but the absence of hydroquinone is not excluded. For example as auxiliary developing compounds may be utilized p-methylaminophenol, a 1-phenyl-3-pyrazolidine-1-one, p-phenylenediamine derivatives and the like. Amounts of hydroquinone are lower than 30 g per litre and more preferably lower than 20 g per litre. Preferred amounts of auxiliary developer are present in a concentration range of up to 10 mmoles per litre of developer, said auxiliary developer being preferably a 1-phenyl-3-pyrazolidine-1-one compound, well-known as a "phenidone" compound.

The developer further comprises silver complexing compound(s) such as alkali metal sulphites, bisulphites, metasulphites or metabisulphites, but preferably it contains an alkali metal sulphite salt, and more preferably sodium sulphite, in an amount from 0 to 50, and more preferably in an amount from 0 to 40 g per litre of developer. The developer solution can be alkalized with alkaline metal hydroxides, phosphates, borates, carbonates and the like. The developer liquid or activator liquid may contain still other ingredients, e.g., metal complexing agents, an anti-fogging agent, e.g., alkali metal bromide, in amounts ranging from 0.01 to 0.4 moles per litre, a benzotriazole, a benzothiazole, a tetrazole, e.g., up to 0.06 g per liter of 1-phenyl-5-mercapto-tetrazole, solvents improving the dissolution of the developing agents, e.g., alcohols, polyethylene glycols and esters thereof and alkanolamines, surface active agents, development retarding or activating compounds, e.g., quaternary ammonium salts, and gelatin hardening agents, e.g., dialdehyde compounds such as glutardialdehyde. Especially the presence of polyethylene glycols having a low molecular weight in the range from 200 to 400 is preferred.

Values of the pH of the developer solution according to this invention, are preferably in the range from 9.0 to 12.5, more preferably in the range of 9.5 to 12.0 and still more preferably from 9.5 to 11.0. Even at those relatively "lower" pH values, if compared with more frequently used alkaline pH values of 12.0 and more, the required sensitometry is still attained, which means that a developer having a composition according to this invention offers enough reactivity to get the required sensitivity for a material that is processed therein within a reasonable processing time.

The present invention thus includes a method for developing, by means of the developer according to this invention, any type of photographic silver halide emulsion layer material, e.g., a graphic art, micrographic and an X-ray recording material, after image-wise exposing the said material by means of suitable radiation sources, adapted to each application in particular, and immersing it into a developer according to this invention.

The development process according to the present invention is advantageously applied in automatic processing equipment, preferably one containing conveyer rollers as described, e.g., in U.S. Pat. No. 3,025,779 and 3,545,971, in a time between 5 and 45 seconds at a temperature between 25° and 40° C.

Preferably the concentration of the derivatives corresponding to formula (II) and the pH are maintained at a constant value by replenishment with unoxidized developing agent, thereby adding a concentrated alkali hydroxide solution under controlled constant redox potential as has been illustrated in EP-A 0 552 511, which is incorporated herein by reference. This invention allows the use of low regeneration amounts of the developer, having a composition according to this invention: minimum regeneration amounts of developing solution from 50 to 250 ml/m$^2$ of photographic material are possible and even more preferred from 50 to 150 ml/m$^2$.

Silver halide emulsions incorporated in at least one photosensitive layer in a suitable layer arrangement of the said materials which can be processed in a developer having a composition according to this invention are composed of silver bromide, silver bromoiodide, non-tabular silver chloride, non-tabular silver chlorobromide, non-tabular silver chlorobromoiodide or a combination thereof.

More preferably silver halide emulsions incorporated in at least one photosensitive layer in a suitable layer arrangement of the said materials which can be processed in a developer according to this invention are composed of tabular silver bromide and/or tabular silver bromoiodide emulsions or a combination thereof or with crystals, the composition of which is cited hereinbefore.

Photosensitive silver halide emulsion layer(s) present in silver halide photographic materials used in the method according to this invention may be of any type or composition used in silver halide photography and may be present in whatever a layer arrangement used in the art of photography. So black-and-white silver halide films intended to be used for contact exposures form an important class of photographic films. These so-called contact films are used for proper reproduction on one hand and for dry dot-etching on the other hand. In modern pre-press graphic arts these contact materials are designed to be useful for several minutes under roomlight conditions, meaning light containing substantially no UV-light. Accurately reproducing the relative proportions of white and black areas of a dot or line image implicates high contrast and high image density. Contact materials usually are processed in Rapid Access chemistry containing hydroquinone, but they give equal or better results, concerning contrast or image density, in Rapid Access chemistry containing ascorbic acid or ascorbic acid derivatives instead of hydroquinone.

The present invention is illustrated by the following example without, however, limiting it thereto.

EXAMPLES

Methods to determine quantitatively the silver deposit present in developing solutions used in the processing of silver halide photographic materials have ever been difficult to be carried out unambigeously. Many factors are indeed playing a role in the phenomenon related to silver deposit:

a. with relation to the film material, the determining factors can be summarized as: the ratio of the exposed to the unexposed surface part of the film (as this ratio is determining the chemical and physical dissolution reactions); water absorption (determined by the degree of hardening of the material); grain size of the emulsions (determining the solubility of the said grains); type of gelatin used in the coated layers; stabilizing compounds (determining silver complexation and adsorption in the rinsing step of the processing) and spectral sensitization (also related with adsorption).

b. with relation to the developer: the sort and the amounts of compounds promoting the solubility of silver ions, the pH value having an influence on complexation, the total volume of the developer in the processing machine and the regeneration volume.

c. with relation to the processing, the agitation and squeezing throughout the rollers, the temperature, the developing time, the simultaneous use of different types of films and the cross-over. Two methods have been worked out.

Method A

Method A makes use of the GEVASET 437N automatic processor, trademarked product from Agfa-Gevaert, which has a tank volume of only 1 litre per tank. The temperature and the processing velocity are made variable. As there is only one roller before entering and after leaving every bath, there is no danger to disturb the outlook of the film surface. Moreover the agitation of the developer is reduced to a negligable extent and the developer tank is followed by two fixation tanks and one rinsing tank, both having a content of 1 litre. At a velocity of 25 cm/min, the film is immersed into the developer tank for 46 seconds at a temperature of 30° C. The developer is not regenerated.

In the exhaustion experiment, according to the "method A" 15 sheets of film, together being equal to a total surface of 1 m$^2$, were processed: 10 sheets were unexposed and 5 sheets of film were completely exposed during 10 minutes in roomlight. The sheets were processed consecutively in the following order: two unexposed films, one exposed film etc.

After exhaustion 1 l of developer was taken from the developer in order to avoid deposit of silver on the walls of the developer tank. A sample thereof was taken to determine the amount of silver present by means of the atomic absorption spectrophotometric (A.A.S.) technique. The beaker was covered with a foil of cellofane and the content was filtered after 24 hours of sedimentation. During said 24 hours the silver deposit has the occasion to grow by agglomeration.

The filtration was carried out under vacuum suction with a Büchner filter apparatus with a filtration paper Rotband Nr 589-5, the weight of which was determined before the operation started. After filtration the filter was rinsed with about 1 l of demineralized water, in order to remove the soluble salts of the developer. The filter paper was dried in an oven for 1 hour at 80° C., whereafter it was cooled for 90 minutes and weighed again. The difference in weight obtained gives an idea about the amount of silver deposit. After 4 weeks the procedure was repeated in order to detect the velocity of sedimentation. From the resulting filtrate a sample was taken to determine the amount of silver therein by means of A.A.S. Experimental data are further given in Example 1.

Method B

In a COPYPROOF 38, trademarked product from Agfa-Gevaert, 4 small developing tanks, each having a content of 150 ml, were built in. The temperature was held constant at a value of 35° C. In each tank an unexposed film having a length of 3 metres and a width of 48 mm was developed. The film was immersed in each tank and transported into the direction of the bottom. As the velocity of the film is 13 minutes per 3 metres, the immersion time is about 30 seconds. All experiments were run twice and as a comparative film SPR712p, trademarked product from Aga-Gevaert, was taken and developed in G101, trademarked product from Agfa-Gevaert. Said film in the G101 developer has a silver deposit of ca. 15 ppm (see further in Example 2). After the development was ended, 50 ml of developer was diluted with 50 ml of a stabilizing solution (800 ppm of GAFAC, trademarked product from 3M, and 400 ppm of 1-phenyl-5-mercaptotetrazole). The rest of the developer was covered with a foil of cellophane in order to control the resulting amount of silver deposit after 24 hours. In the diluted sample the silver concentration was measured again by means of A.A.S.

Exhaustion Materials

As a silver halide photographic material used in order to exhaust the developer solution, STRUCTURIX D4, trademarked product from Agfa-Gevaert for industrial radiography (non-destructive testing), was chosen. This material is double-side coated and contains an amount of ca. 21 g of silver, expressed as the equivalent amount of silver nitrate per square metre. The said material has been chosen in some experiments in order to reduce the amount of film to a minimum.

The following silver halide materials A and B were prepared in order to be coated identically to the STRUCTURIX D4 material as the normally present cubic crystals having 99 mole % of silver bromide and 1 mole % of iodide ions used therein.

Material A

A cubic silver chlorobromoiodide emulsion having 97.6 mole % of silver chloride, 2 mole % of silver bromide and 0.4 mole % of silver iodide. This emulsion was prepared at a pH value of 5.0 and a constant pAg value of 7.35. Its grain size was 0.30 μm and its gesi (ratio of the amount, in grams, of gelatin to silver expressed as the equivalent amount of silver nitrate) was 0.5. The said emulsion was optimally sulphur and gold sensitized.

Material B

A cubic silver bromide emulsion having 100 mole % of silver bromide. This emulsion was prepared at a constant pAg value of 8.2. Its grain size was 0.33 μm and its gesi was 0.4. The said emulsion was optimally sulphur and gold sensitized.

For each material A and B amounts of gelatin were added before coating in order to get the same total coating amounts of gelatin in the light-sensitive emulsion layer for each "STRUCTURIX D4" material. The pH value before coating was also adjusted to the same value of 5.5.

Material C

For another exhaustion experiment (see example 2) the graphic material SPR712p (trademarked product from Agfa-Gevaert, having an emulsion rich in chloride: 83.6 mole % of chloride, 16 mole % of bromide and 0.4 mole % of iodide) was chosen. This material is called material C. This material is single-side coated and contains an amount of ca. 7.5 g of silver, expressed as the equivalent amount of silver nitrate per square metre.

Films for Determining the Sensitometry

In order to show that sensitometric results are matching in the different developers according to this invention the following "reference films" were prepared.

Film A

This is a material having AgBr(I) tabular crystals in its emulsion layers, wherein 1 mole % of silver iodide is present. It was prepared as described in EP-A 0 577 886. This emulsion was caoted as follows:

The emulsion was stabilized with 4-hydroxy-6-methyl-1,3,3a,7-tetraazaindene and after addition of the normal coating additives the solutions were coated simultaneously together with a protective layer containing 1.1 g gelatine per $m^2$ per side on both sides of a polyethylene terephthalate film support having a thickness of 175 μm. The resulting photographic material contained per side an amount of silver halide corresponding to 3.5 grams of $AgNO_3$ per $m^2$.

Film B

This is a material having pure AgCl cubic crystals in its emulsion layers. It was prepared in the following way.

A silver chloride emulsion having cubic silver chloride crystals was prepared by a double jet technique. The silver halide composition was 100 mole % of chloride and the average grain size was 0.55 μm. Therefor an amount of 615 ml of demineralized water was used as starting volume in the vessel, containing further 46 g of inert gelatin and 10.3 mmoles of sodium chloride at 60° C. Concentrated solutions of 1 l of $AgNO_3$ and NaCl, 3 N each, were run with the double jet technique at a rate of 20 ml per minute for the silver nitrate solution during 50 minutes and at a rate of 20.83 ml per minute for the sodium chloride solution during 48 minutes. After an additional physical ripening time of 15 minutes at the end of the precipitation the flocculation procedure could begin: pH was adjusted at a value of 3.3 with a 3 molar solution of sulphuric acid, and 4.5 g of polystyrene sulphonic acid was added slowly in 2 minutes. The washing procedure was performed in a discontinous way, adding 3 l of demineralized water, containing up to 8 mmole of sodium chloride pro liter, until pAg was reaching a value of about 7.3. After addition of inert gelatin to a ratio of gelatin to silver nitrate in the emulsion of about 0.35, the emulsion was peptized and was chemically ripened to an optimal fog-sensitivity relationship at 52° C., pAg having a value of about 6.95. Chemical ripening agents, besides gold (in an amount of 0.019 mmole) and sulphur (tetramethyl thiodithiocarboxylic acid diamide in an amount of 0.061 mmole), were toluene thiosulphonic acid and iodide ions, both being predigestion agents in amounts of 0.02 and 8.6 mmoles respectively.

A photographic material was prepared having on a subbed polyester base a gelatinous silver halide emulsion of which the silver halide consists for 99.7% of silver chloride having an average grain size of 0.55 μm the preparation of which has been described above. Before coating said emulsion was spectrally sensitized with two spectral sensitisers, corresponding to the following formulae (see compound III and compound IV):

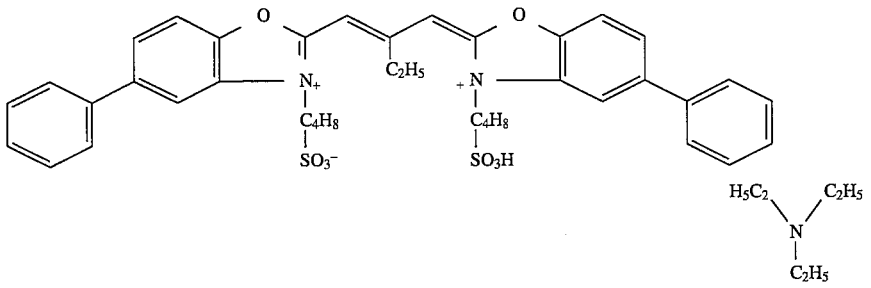

(III)

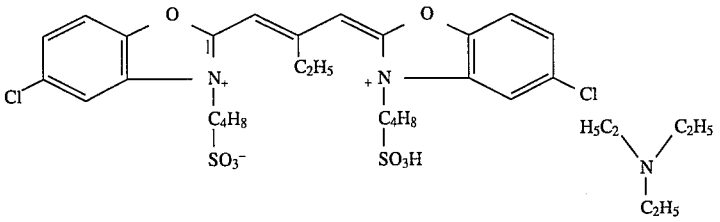

(IV)

These spectral sensitizers were added consecutively in an amount of 0.1 mmole and 0.3 mmole per mole of silver nitrate respectively. The emulsion was further stabilized with 0.22 mmole of compound (V) and 0.68 mmole of compound (VI) per mole of silver nitrate.

(V)

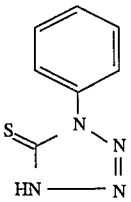

-continued (VI)

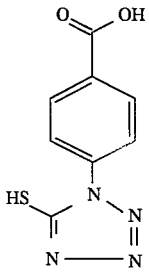

A coated amount of silver expressed as the equivalent amount of silver nitrate of 3.8 g per square metre and a gelatin to silver chloride (expressed in equivalent amount of silver nitrate) ratio of 0.35 was provided with a gelatin covering layer (anti-stress layer) of 1.30 g of gelatin per m2.

| | Compositions of the developers | | | | | |
|---|---|---|---|---|---|---|
| Type of dev. | DEV1 * | DEV2 | DEV3 | DEV4 ** | DEV5 | DEV6 |
| pH ready-for-use | 10.1 | 10.0 | 10.0 | 10.5 | 10.0 | 10.0 |
| Hardening | Yes | No | No | No | No | No |
| Hydroquinone(mole/l) | 0.27 | 0.18 | 0 | 0.18 | 0.18 | 0.18 |
| 1-phenyl-3-pyrazolidi ne-1-one(mmole/l) | 9.3 | 4.6 *** | 4.6 *** | 3 | 3 | 3 |
| 5-nitro-indazole(mmole/l) | 1.5 | — | — | — | — | — |
| 1-phenyl-5-mercap-totetrazole (mmole/l) | — | — | — | 0.17 | 0.17 | 0.17 |
| $Br^-$ (mmole/l) | 33.6 | 30 | 30 | 84 | 84 | 84 |
| 5-methylbenzo-triazole (mmole/l) | 0.7 | — | — | — | — | — |
| $SO_3^{--}$ (mole/l) | 0.37 | 0.19 | 0.19 | 0.41 | 0.25 | 0.25 |

-continued

| Type of dev. | Compositions of the developers DEV1 * | DEV2 | DEV3 | DEV4 ** | DEV5 | DEV6 |
|---|---|---|---|---|---|---|
| $CO_3^{--}$ (mole/l) | 0.23 | 0.69 | 0.69 | 0.17 | 0.27 | 0.27 |
| Polyglycol (ml/l) (M.W. = ca. 400) | 0.25 | 20 | 20 | — | — | — |
| $SCN^-$ (mmole/l) | — | 25.7 | — | — | — | — |
| compound VII (mmole/l) | — | — | 1.4 | — | — | 1.75 |
| Ascorbic Acid (mole/l) | — | 0.11 | 0.28 | — | 0.11 | 0.11 |
| $I^-$ (mmole/l) | — | — | — | — | — | — |
| $K^+$ (%) | 100 | 100 | 100 | 100 | 0 | 0 |
| $Na^+$ (%) | 0 | 0 | 0 | 0 | 100 | 100 |

*DEV1: developer G138, trademarked product from Agfa-Gevaert
**DEV4: developer G101, trademarked product from Agfa-Gevaert DEV1 and DEV4 are commercially available developers.
***methyl-substituted compound

Example 1

In Table 1 amounts of deposited silver determined by means of method A described hereinbefore in Exhausted Developer (ED), after 24 hours (in mg/l)(ED24), after 4 weeks present in the filtrate (mg/l)(ED4W) as well as the Total Deposit (mg/l) (TD) and the rest amount of Deposited Silver in the Filtrate (DSF) are given for materials A (rich in AgCl, having 97.6 mole % of AgCl) and for materials B (rich in AgBr, having 100 mole % of AgBr) in different developers DEV2 and DEV3.

TABLE 1

| Developer | Mat. | AgX | ED | ED24 | ED4W | TD | DSF |
|---|---|---|---|---|---|---|---|
| DEV1 | A | AgCl | 21.0 | 6.7 | 6.3 | 13.0 | 8.5 |
| (ref.) | B | AgBr | 9.1 | 6.4 | 0.7 | 7.1 | 1.3 |
| DEV2 | A | AgCl | 11.5 | 9.7 | 0.5 | 10.2 | 1.7 |
| (comp.) | B | AgBr | 3.6 | 1.0 | 1.2 | 2.2 | 1.6 |
| DEV3 | A | AgCl | 6.8 | 5.7 | 0.8 | 6.5 | 0.3 |
| (inv.) | B | AgBr | 2.7 | 2.6 | 0.2 | 2.8 | 0.1 |

As can be concluded from Table 1 the developer DEV3, according to this invention, makes the amount of silver deposit decrease about 40% for materials comprising emulsion crystals rich in AgCl and about 25% for materials comprising emulsion crystals rich in AgBr in comparison with the developer DEV2.

The sensitometric results are matching those obtained with the reference developer DEV1 as has been illustrated in Table 2.

Samples of both coating materials were exposed according to the ANSI procedure 1043. After processing in the developers mentioned in Table 2 for developing times of 22 seconds at 33° C., the sensitometric properties of each material were measured.

Therefor the density was measured as a function of the light dose and therefrom were determined the following parameters:

fog level (with an accuracy of 0.01 density);

the relative speed at a density of 1 above fog (expressed in logarithmic terms of exposure amount: a decrease of the speed with 0.30 is equivalent with a speed enhancement with a factor 2);

the contrast, calculated between the densities 0.25 and 2.0 above fog and the maximum density.

TABLE 2

| Developer | Film | Composition | Fog | Speed | Contrast | Dmax |
|---|---|---|---|---|---|---|
| DEV1 | A | AgBr | 0.04 | 1.67 | 2.85 | 3.40 |
| (ref.) | | | | | | |
| DEV2 | A | AgBr | 0.03 | 1.52 | 3.31 | 3.88 |
| (comp.) | B | AgCl | 0.05 | 1.66 | 4.20 | 3.60 |
| DEV3 | A | AgBr | 0.08 | 1.48 | 3.31 | 3.72 |
| (inv.) | B | AgCl | 0.05 | 1.66 | 4.01 | 3.53 |

As can be seen from Table 2, the sensitometric properties for film B in DEV2 or DEV3 are matching very well with those required in DEV1 for film A or show that the use of shorter development times in DEV2 and DEV3 is permitted (more rapid processing) as its speed values are indicative for a higher speed obtained. Film material A has in its composition 99 mole % of AgBr; film material B 99.7 mole % of AgCl as set forth hereinbefore.

Example 2

In this Example a comparison is given of the sensitometry obtained with Material C (SPR712p, having an emulsion rich in chloride: 83.6 mole % of chloride, 16 mole % of bromide and 0.4 mole % of iodide) and SF712p (having an emulsion rich in bromide: 99 mole % of bromide, 1 mole % of iodide). Both materials are trademarked products from Agfa-Gevaert). The development was carried out in DEV4 (=G101, typical graphic standard developer) and modifications thereof (DEV5 and DEV6), resulting in a developer according to this invention. Method B described hereinbefore was applied in order to determine the amount of silver deposit. Results are summarized in Table 3.

TABLE 3

| Developer | Silver deposit in exhausted developer (in mg/l) |
|---|---|
| DEV4 (ref.) | 15.7 |
| DEV5 (comp.) | 3.6 |
| DEV6 (inv.) | 3.4 |

As can be concluded from Table 3, the reduction of sulphite ions, the presence of ascorbic acid together with the use of sodium salts instead of potassium salts reduces the silver deposit with 75%

A sensitometric evaluation is given in Table 4 wherein the effect of the presence of pyridinium compound (VII) is shown.

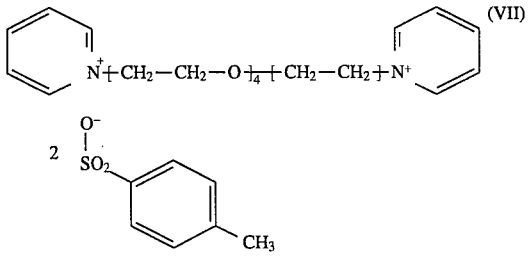

(VII)

The speed values defined as log exposure values at optical density 3.00 above fog were expressed as logarithmic values. GRD1 represents the "toe" gradation, whereas GRD2 represents the rectilineal gradation.

TABLE 4

| | SF712p | | | | | SPR712p | | | | |
|---|---|---|---|---|---|---|---|---|---|---|
| DEV | FOG | SENS | GRD1 | GRD2 | DMAX | FOG | SENS | GRD1 | GRD2 | DMAX |
| DEV4 | .03 | 2.20 | 2.43 | 6.50 | 4.65 | .03 | 1.47 | 2.46 | 9.77 | 5.72 |
| DEV5 | .03 | 2.30 | 2.05 | 6.21 | 4.32 | .03 | 1.53 | 2.02 | 9.33 | 5.42 |
| DEV6 | .04 | 2.06 | 2.73 | 6.24 | 4.67 | 04 | 1.37 | 2.78 | 9.36 | 6.02 |

As can be seen from Table 4 the required sensitometry can only be obtained for DEV5 if compound (VII) is added (see DEV6=DEV5+compound VII, according to this invention).

We claim:

1. Photographic developing solution comprising hydroquinone in an amount from 0 to 30 g per litre, an auxiliary developer, and silver halide complexing agents in an amount from 0 to 50 g per litre, characterized in that said developer further comprises in amounts from 0.1 to 5 g per litre a compound corresponding to the formula (I), accompanied by charge compensating anions, $$Z'N^+—R—N^+Z'' \quad (I)$$

wherein at least divalent group R contains at least one oxyethylene group and wherein Z' and Z", being the same or different, are composed of enough atoms to form a heterocyclic aromatic 5- or 6-ring;

and at least 1 g of a compound corresponding to the formula (II), a precursor thereof, a derivative thereof and/or a metal salt thereof

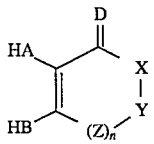

(II)

wherein each of A, B and D independently represents an oxygen atom or $NR^1$;

X represents an oxygen atom, a sulphur atom, $NR^2$; $CR^3R^4$;C=O; C=$NR^5$ or C=S;

Y represents an oxygen atom, a sulphur atom, $NR'^2$; $CR'^3R'^4$; C=O, C=$NR'^5$ or C=S;

Z represents an oxygen atom, a sulphur atom, $NR''^2$; $CR''^3R''^4$; C=O; C=$NR''^5$ or C=S;

n equals 0, 1 or 2;

each of $R^1$ to $R^5$, $R'^1$ to $R'^5$ and $R''^1$ to $R''^5$, independently represents hydrogen, alkyl, aralkyl, hydroxyalkyl, carboxyalkyl; alkenyl, alkynyl, cycloalkyl, cycloalkenyl, aryl or heterocyclyl;

and wherein $R^3$ and $R^4$, $R'^3$ and $R'^4$, $R''^3$ and $R''^4$, may further form together a ring; and wherein in the case that X=$CR^3R^4$ and Y=$CR'^3R'^4$, $R^3$ and $R'^3$ and/or $R^4$ and $R'^4$ may form a ring and wherein in the case that Y=$CR'^3R'^4$ and Z=$CR''^3R''^4$ with n=1 or 2, $R'^3$ and $R''^3$ and/or $R'^4$ and $R''^4$ may form a ring.

2. Photographic developing solution according to claim 1, wherein in the formula (I) the said heterocyclic aromatic rings are the same or different and represent a pyridine, a pyrimidine, an imidazol, a benzimidazol, a thiazol, a benzothiazol or a derivative thereof.

3. Photographic developing solution according to claim 1, wherein in the formula (I) at least divalent group R represents at least 3 oxyethylene-units.

4. Photographic developing solution according to claim 1, wherein the formula (I) corresponds to the structure

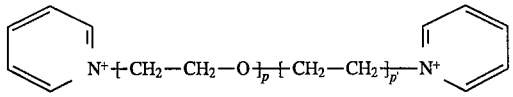

wherein p=3 to 10 and p'=1 to 4.

5. Photographic developing solution according to claim 4, wherein p equals a value of 4 and whereas p' equals a value of 1.

6. Photographic developing solution according to claim 1, wherein at least one compound according to the formula (I) is present in an amount of from 0.5 to 2.5 g per litre.

7. Photographic developing solution according to claim 1, wherein in formula (II) A, B and X each represent an oxygen atom; n=0; Y=CH—$(CHOH)_m$—$CH_2$—$R^6$ wherein m=1, 2, 3 or 4 and wherein $R^6$ represents OH for m=1; H or OH for m=2, 3 or 4.

8. Photographic developing solution according to claim 1, wherein in formula (II) A and B each represent an oxygen atom; n=0 and each of X and Y represents $C(CH_3)_2$.

9. Photographic developing solution according to claim 1, wherein the said compound according to the formula (II) is present in an amount between 1 g and 50 g per litre.

10. Photographic developing solution according to claim 1, wherein said solution has a pH value in the range from 9.0 to 12.5.

11. Photographic developing solution according to claim 1, wherein said solution has a pH value in the range from 9.5 to 11.0.

12. Photographic developing solution according to claim 1, wherein the said silver halide complexing agents are alkali metal sulphite salts.

13. Photographic developing solution according to claim 1, wherein the said alkali metal sulphite salts are present in an amount of less than 40 g per litre.

14. Photographic developing solution according to claim 1, wherein the amount of hydroquinone is less than 20 g per litre.

15. Photographic developing solution according to claim to 1, wherein said auxiliary developer represents at least one 1-phenyl-3-pyrazolidine-1-one developing agent in a concentration ranging up to 10 mmoles per litre.

16. Photographic developing solution according to claim 1, which further contains an alkali metal bromide salt in a concentration ranging from 0.01 to 0.4 moles per litre.

17. Method for developing an image-wise exposed photograpic material comprising the step of immersing said material in a photographic developing solution according to claim 1.

18. Method according to claim 17, wherein the concentration of the compound corresponding to the formula (I) and the pH value are maintained at a constant value by replenishment with unoxidized developing agent, thereby adding a concentrated alkali hydroxide solution under controlled constant redox potential.

19. Method according to claim 17, wherein the replenishment is carried out in amounts from 50 to 250 ml/$m^2$ of photographic material.

20. Method according to claim 17, wherein the replenishment is carried out in amounts from 50 to 150 ml/$m^2$ of photographic material.

21. Method according to claim 17, wherein the development proceeds in an automatic processor in a time between 5 and 45 seconds at a temperature between 25° and 40° C.

* * * * *